United States Patent [19]

Hsu

[11] 4,228,562

[45] Oct. 21, 1980

[54] BILATERAL SWINGABLE SELF-CLOSING DOOR HINGE

[76] Inventor: Yun T. Hsu, 30-27, Chun In Rd., Chun In Village, Tong Sun Hsiang, I Lan Hsien, Taiwan

[21] Appl. No.: 946,057

[22] Filed: Sep. 25, 1978

[51] Int. Cl.[2] ..... E05F 1/06

[52] U.S. Cl. ..... 16/154

[58] Field of Search ..... 16/154, 153, 152, 137, 16/DIG. 40, 171, 160, 155, 168, 169

[56] References Cited

U.S. PATENT DOCUMENTS

| | | | |
|---|---|---|---|
| 1,374,437 | 4/1921 | Coombs | 16/154 |
| 1,691,759 | 11/1928 | Fischer | 16/153 |
| 2,702,399 | 2/1955 | Pinion et al. | 16/153 |
| 3,089,184 | 5/1963 | Kerman | 16/154 X |

*Primary Examiner*—George H. Krizmanich

*Attorney, Agent, or Firm*—Cushman, Darby & Cushman

[57] ABSTRACT

A self-closing door hinge which may be mounted for clockwise or counterclockwise opening of a door. Hinge arms are provided which permit the hinge socket part and hinge axle to be uprightly oriented irrespective of the orientation of the hinge leaves to which they are fixed. The socket part includes an inner socket having a pair of vertically spaced, inclined, orbital rail grooves. The axle has recesses which hold ball bearings which support the socket part and ride in the grooves so that the door automatically closes when the door is released with the ball bearing on the inclined portion of the orbital grooves.

5 Claims, 22 Drawing Figures

BILATERAL SWINGABLE SELF-CLOSING DOOR HINGE

RELATIONSHIP TO PRIOR FILED APPLICATION

This invention relates to a door hinge with the advantages of self-closing and bilateral swingability and is an improvement over the invention disclosed in copending application of the same petitioner, Ser. No. 907,860 titled Self-Closing Door Hinge, filed on May 19, 1978.

BACKGROUND OF THE INVENTION

Popular known type of door hinges feature two hinge leaves both with one side in section hooks alternatively put together to form a center pivoting part jointed by an axle bolt, and these two hinge leaves are respectively secured onto the door frame (architrave) and the door leaf (stile or jamb), so that the door can therefore turn thereon to open or close. Among those hinges some are of the self-closing type which use a returnable spring or hydraulic device. Such hinges are believed not to operate in the way that the present invention operates.

SUMMARY OF THE INVENTION

In accordance with the present invention, there is an upper hinge leaf for being secured on the door leaf and connected to an upper hinge arm extended from an upper socket. There is also one lower hinge leaf for being secured on the door frame and connected to an axle base which with an center axle suitably bolts into the upper socket of the upper hinge leaf. On the inner surface of the socket, there are two oblique orbitlike rail grooves each of which receives a steel ball rotatably positioned on the axle. Whenever the door is turned to open, the rail grooves will route the socket together with the upper hinge leaf and the door in an inclined upward motion as the grooves turn on the steel balls. can be devided as follows. At the beginning of the door opening, the rail grooves enable the door to turn 50° in horizontal plane and sequentially goes on up when exceeding the first 50° where door is assumed to entirely leave the door frame restriction. After the completion of the door opening, the door goes down automatically by the gravity force on the door itself and therefore turns back to close.

Except as described above, the two hinge leaves of the present hinge are removable and resettable to the hinge arms enabling the present invention to be used both in right and left-open purposes.

It is not essential that the rail grooves must be able to route the door turning in horizontal plane within 50° angle to enable the door the entirely leave the door frame restriction. It also depends on the length of the hinge arms and the slope of the hinge arms to the door wall. The specific angle of horizontal movement is an essential aspect of the invention.

BRIEF DESCRIPTION OF THE DRAWINGS

The following description taken in the accompanying drawings based on a given 50° plane angle displacement for the door, wherein.

FIG. 2-A is a vertically opened view of the present invention socket.

FIG. 2-B is a front view of the present invention socket.

FIG. 2-C is a back view of the present invention socket.

FIGS. 2D and 2E are sectional views of the rail grooves shown in FIGS. 2B and 2C.

FIG. 3-B is a counter motion of the FIG. 3-A.

DETAILED DESCRIPTION OF THE INVENTION

Figures 1A, 1B:
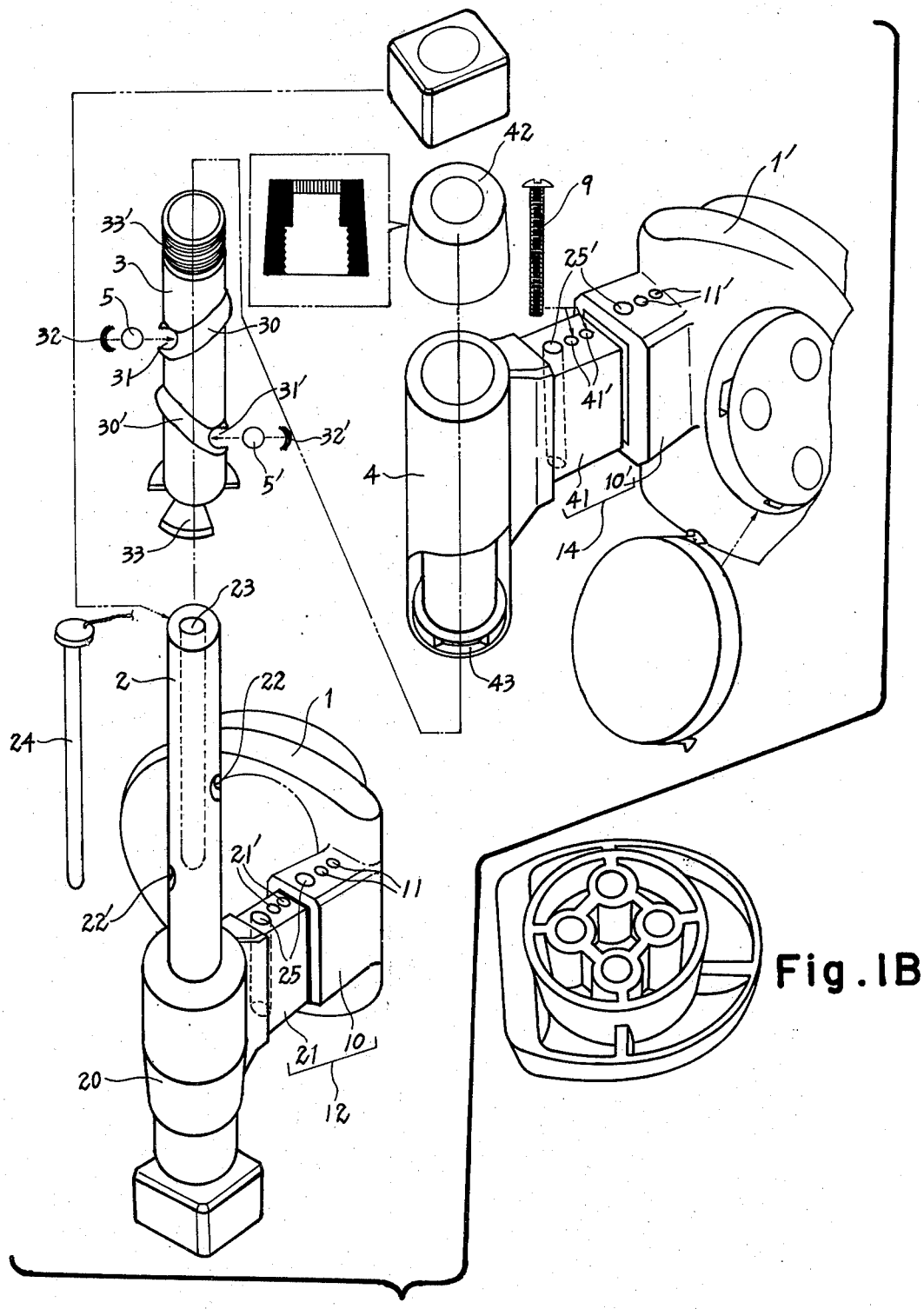
FIG. 1A and FIG. 1B show an exploded perspective view of the present invention.
Figure 2E:
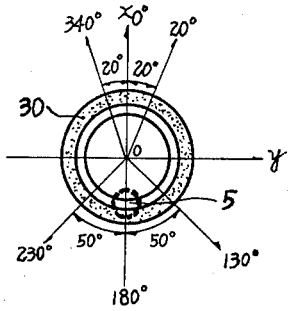
Figure 2E:
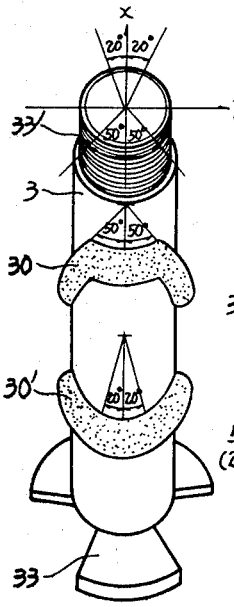
Figure 2E:
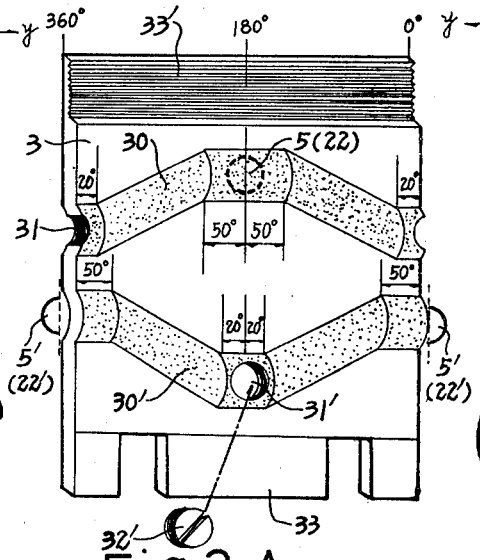
Figure 2E:
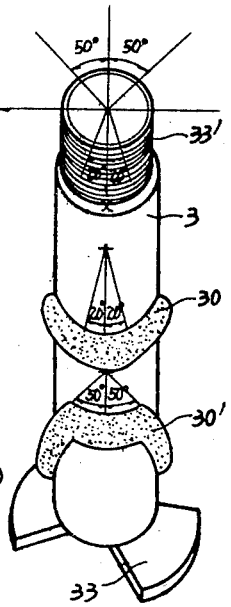
Figure 2E:
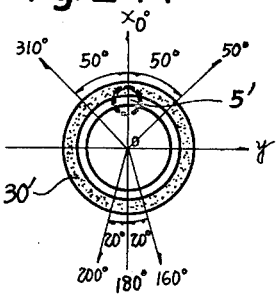
Figure 3A:
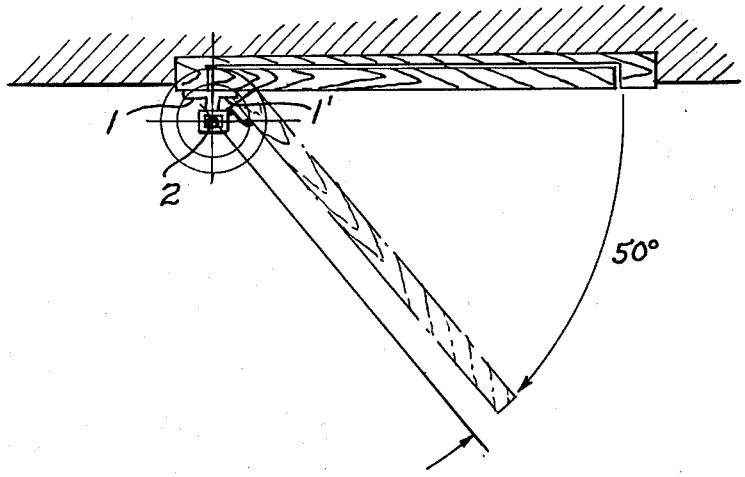
FIG. 3-A is a top view of the door opening clockwisely in 50° angle displacement where the door entirely leaves the door frame restriction.
Figure 3B:
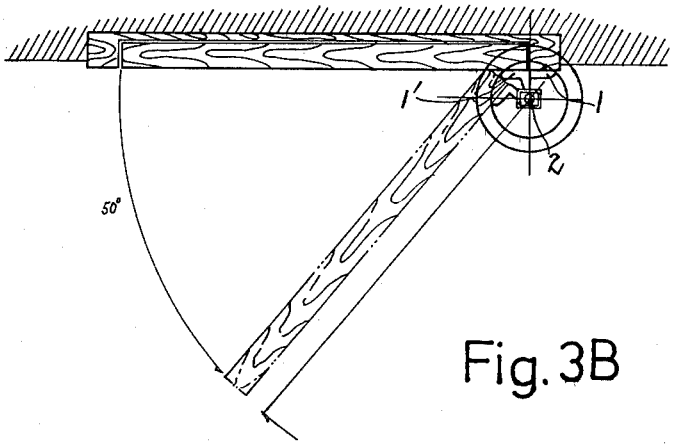

Before further specifying the invention structures, functions and objects, the petitioner would like to emphasize again the specially given angle displacement, 50°, as an initial plane motion of the invention hinge appears in the following description and the accompanying drawing merely for a purpose of easy clarity.

Referring to FIGS. 1, 4, 8, 9 & 10, the present hinge includes one upper hinge leaf 1' for being secured onto a door leaf and one lower hinge leaf 1 for being secured onto a door frame. Lower hinge leaf 1 includes a socket cap 10 fitted around an arm plunger 21 extended from a lower axle base 20, socket cap 10 and arm plunger 21 to form a lower hinge arm 12. Axle base 20 has a center axle 2 grown up from its center as a bolt for bolting into an inner socket 3. Inner socket 3 has an end stopper positioned to reside inside indent portion 43 of outer socket 4 and with threaded top 33 for being screwed firmly by screw cap 42 both inner socket 3 & outer socket 4 therefore being fitted firmly together to form one single socket part as a main pivoting center part of the present invention hinge. Similarily, outer socket 4 with an arm plunger 41 suitably fitted into a cap socket 10' of the upper hinge leaf 1' composes an upper hinge arm 14. Screws 9 serves as the main elements for joining the elements which form upper arm 14 and lower arm 12.

When the present invention hinge is employed, the upper hinge leaf 1' is secured onto the door leaf and the lower hinge leaf 1 is secured onto the door frame. The upper hinge leaf 1', upper arm 14 and the socket part 3, 4 as the turnable part, together with the door, turn on the axle 2 of the lower axle base 20. Lower axle base 20, lower hinge arm 21 and lower hinge leaf 1 serve as the fixed part of the hinge.

Figures 7A, 7B:
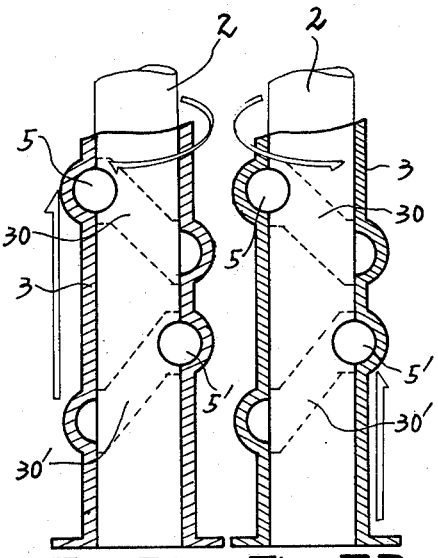
FIGS. 7A and 7B show the arrangement and the loading of two oblique orbit-liked rail grooves and two steel balls.

FIGS. 1, 2 & 7 show in detail the arrangement of two steel balls 5 & 5' and two rail grooves 30 & 30'. On FIG. 1, axle 2 has two ports 22, located & 22' back to back on opposite sides along the longitudinal axis of axle 2 with a certain distance along the longitudinal axis of axle 2 between them, for respectively receiving one each of steel balls 5 & 5'. On FIG. 2, rail grooves 30 & 30' feature an oblique orbit spiral on the inner surface of the inner socket 3 for receiving steel balls 5 & 5' inside. Thus, grooves 30 and 30' are identically orbitally shaped but identical points thereon are rotated 180°, with respect to each other. Corresponding points on each groove are therefore vertically spaced from each other the same distance as the vertical distance between ports 22 and 22' both grooves havinh a horizontal high section of about 100° radian at facing sides across the longitudinal axis in the bore center of the socket 3 and a horizontal low section of about 40° radian. The two horizontal high sections (or two plane low sections) of the rail grooves are located at the same distance to a corresponding one of two ports 22 & 22' (or balls 5 & 5') of the axle 2 for enabling both balls 5 & 5' to roll inside the rail grooves of socket 3 while turning in ports 22 and 22', respectively. In other words, when the upper groove 30 has its horizontal high section right at longitude 180° of the socket so as to receive upper ball 5 at its middle ball 5 divides the high section og grooves 30 into left horizontal sections 50° plane radians. In this orientation the lower groove 30' receives with its horizontal low section right at 0° of the socket receives lower ball 5' at the middle of its horizontal low section so as to divide the section into left 20° and right 20° plane radians. In the closed state of the present hinge, upper ball port 22 is right at the 180° longitude and the upper ball 5 therefore resides right in the middle of the horizontal high section of the upper groove 30, and lower ball port 22' is located at the 0° longitude and the lower ball 5' therefore resides right in the middle of the horizontal low section of the lower groove 30'.

When the door is turned clockwise from the closed state to open (it is the same if the door is counter-clockwisely turned to close), the balls 5 & 5' respectively guide the rail grooves 30 & 30' of the socket 3 (together with the door) in a horizontal plane within 50° at first, and then sequentially guide the rail grooves 30 & 30' upward and lift gradually the socket parts 3 and 4 (together with the door) when the socket parts 3 and 4 (and the door) exceeds the 50° range. And whenever the door opening is finished with the balls 5 and 5' respectively short of the horizontal low sections of grooves 30 and 30', the gravitational force on the door will make the rail grooves 30 and 30' dropping down and turning back on the balls of the axle and finally back to the original closed state. The horizontal low sections of the rail grooves are effective only for the balls to rest on and enabling the door to remain in the at opened state.

Figure 4:
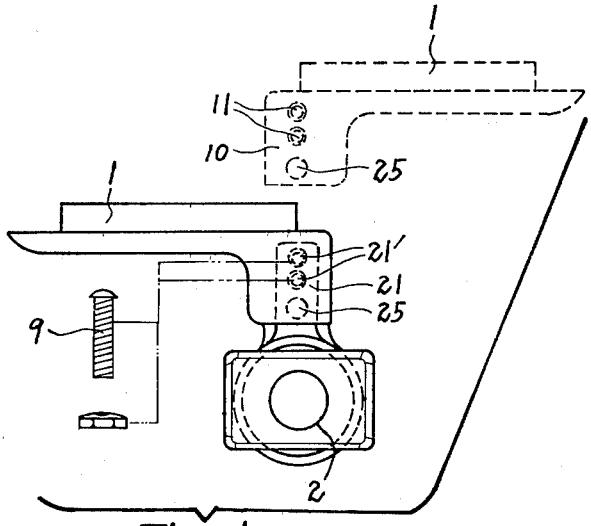
FIG. 4 is a top view of the invention showing hinge leaf resettable conversely for bilateral opening purpose.
Figure 5A:
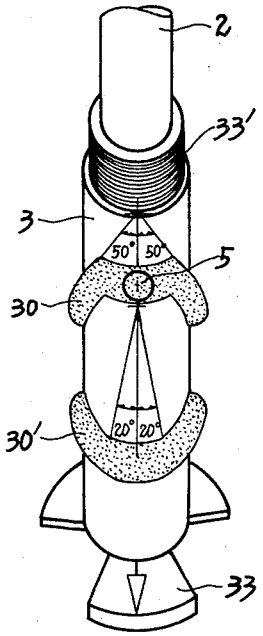
FIGS. 5A, 5B and 5C showing the motions of the present hinge socket clockwisely opened in different stages.
Figure 5B:
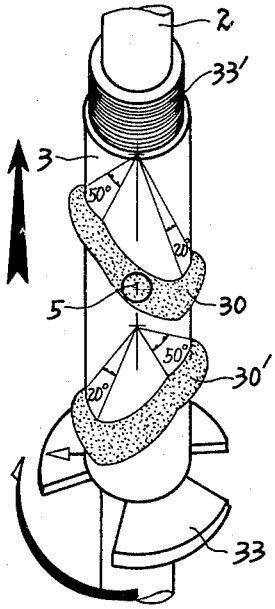
Figure 5C:
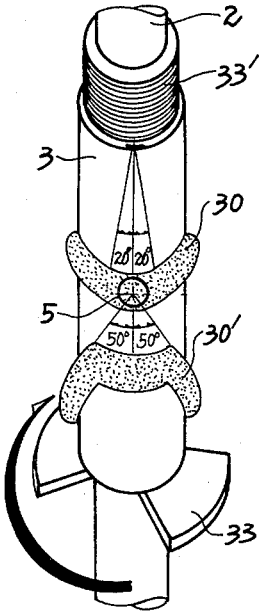
Figure 6A:
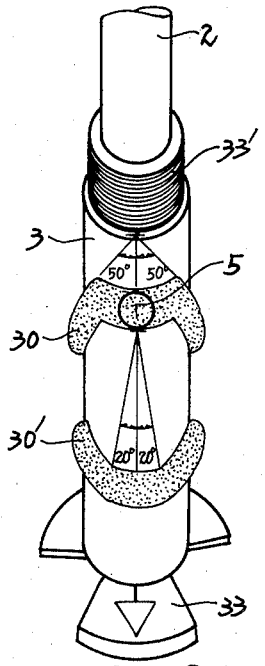
FIGS. 6A, 6B and 6C showing the motions of the present hinge socket counter-clockwisely opened in different stages.
Figure 6B:
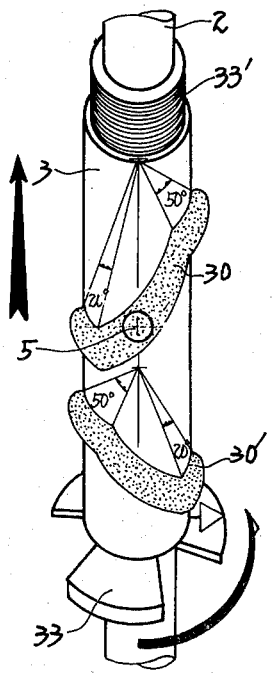
Figure 6C:
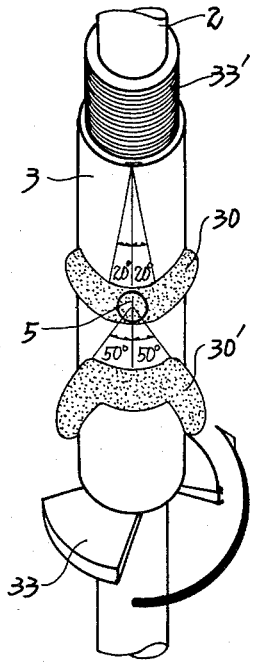
Figure 8B:
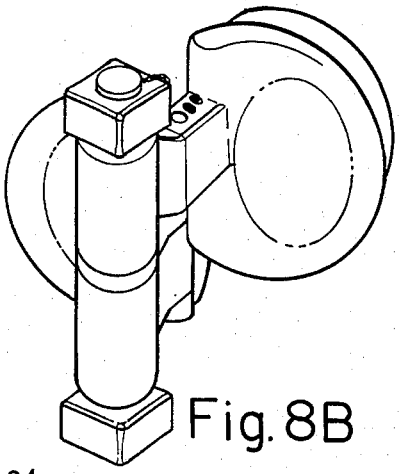
FIGS. 8A, 8B and 8C are a perspective view of the present invention.
Figure 8C:
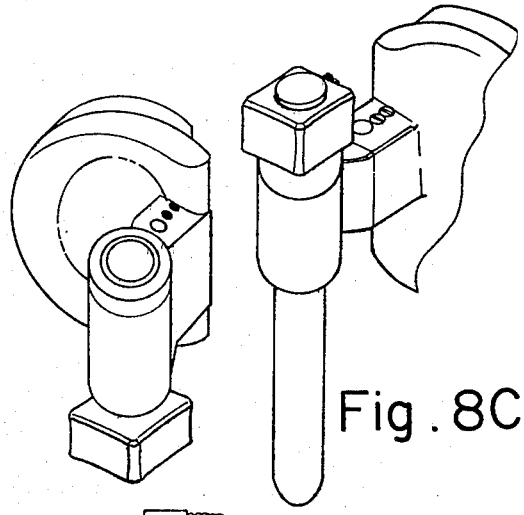
Figure 8A:
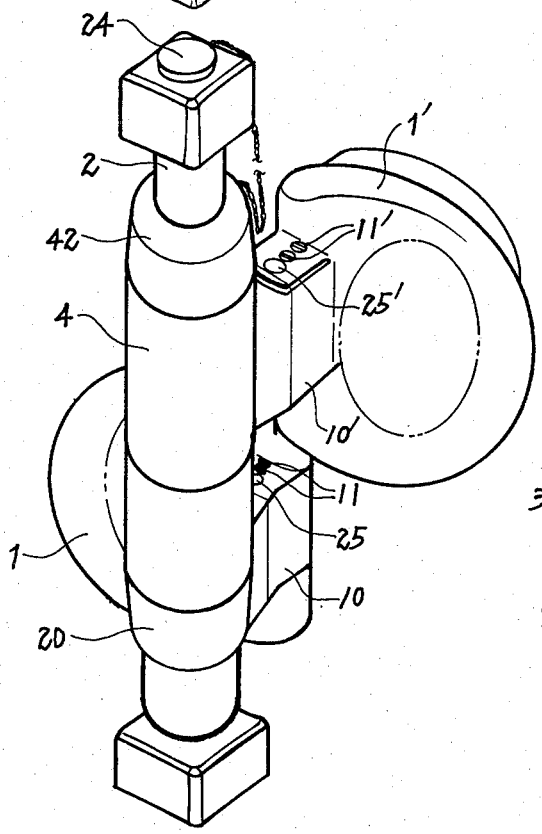
Figure 9A:
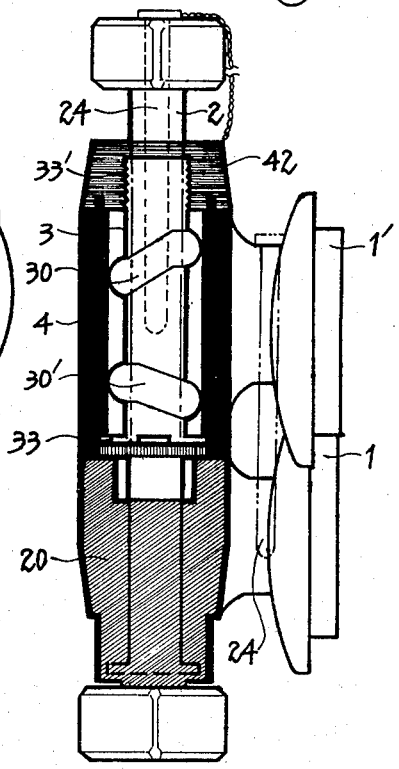
FIG. 9 is a vertically cut view of the present invention.

As specified above, clockwise door opening or closing motions are independent of the swinging direction of the door. It can be realized that when the present hinge is secured on the left side of the door, the door can be opened only clockwise. FIG. 4 shows how to fit the present hinge secured on the right side of the door and enable the door to open counter-clockwise. When securing the present hinge on the right side of the door, the upper hinge leaf 1' shall be on the door and the lower hinge leaf 1 on the door frame, thus one can turn both hinge leaves 180° over and refit them into the respective hinge arms again. FIG. 4 shows merely the resetting of the lower hinge leaf 1 and can be realized in the same manner for the upper hinge leaf 1'. Lower hinge leaf 1 has two spaced holes 11 hollowed through the top side and bottom side of the square cap socket 10. Arm plunger 21 has two spaced holes 21' which match holes 11 so that they may be aligned and fixed by screw 9 whenever arm plunger 21 is fitted inside the cap socket 10. This structure of the hinge leaf and the arm plunger makes the hinge leaf removable and resettable.

The present invention hinge includes an extra latching device as shown on FIG. 1. Referring to FIG. 1, when the door is closed holes 25 on lower hinge arm 12 and holes 25' in upper hinge arm 14 are vertically aligned. A pin 24 is normally placed inside on a center bore 23 of the axle 2. However, pine 24 may also be in latching through both holes 25 & 25' of the hinge arms 12 & 14 when the door is closed so as to lock the door.

What is claimed is:

1. A bilateral swingable self-closing door hinge for mounting to a door having a door leaf and a door frame, comprising:

a first hinge part, said first hinge part including a lower axle base having an upwardly extending center axle, a first hinge leaf including means for securing said first hinge leaf to the door leaf in either an upright or upside down orientation, and means mounted to said lower axle base for removably rigidly mounting said lower axle base to said first hinge leaf with said center axle upright and said first hinge leaf secured to said door either upright or upside down, a second hinge part, said second hinge part including a socket part slidably and rotatably fitted onto said center axle, a second hinge leaf including means for securing said first hinge leaf to the door frame, in either an upright or an upside down orientation, and means mounted to said socket part for removably rigidly mounting said socket part to said second hinge leaf with said second hinge leaf either upright or upside down so that said door hinge may be mounted to either the left side of said door for counterclockwise opening or to the right side of said door for clockwise opening with said center axle upright;

said second hinge part including means, associated with said center axle and said socket part, for causing said first hinge leaf to rise when swung in one direction from a first position relative to said center axle and to rise when swung in the opposite direction from said first relative position.

2. A bilateral swingable self-closing door hinge for mounting to a door having a door leaf and a door frame, comprising:

a first hinge part, said first hinge part including a lower axle base having a center axle, said axle having a vertical longitudinal axis, and a vertical side surface, and a first hinge leaf for being secured to the door leaf, and means for rigidly mounting said lower axle base to said first hinge leaf;

a second hinge part, said second hinge part including a socket part having a vertical inside surface slidably and rotatably fitted onto said center axle, a second hinge leaf for being secured to the door frame, and means for rigidly mounting said socket part to said second hinge leaf;

said center axle having first and second vertically spaced recesses in said side surface whose centers are each located at a corresponding angle of rotation about said longitudinal axis separated by 180°;

each of said recesses receiving a respective ball bearing therein at said corresponding angle;

said socket part having nonintersecting first and second vertically inclined orbital rail grooves in said inside surface respectively engaged by and rollable in said first and second ball bearings;

said grooves each having a vertical peak and a vertical bottom so that when said balls are located at said vertical bottom, said first hinge leaf and socket rise when rotated in either clockwise or counterclockwise direction.

3. A door hinge as in claim 2 wherein said first and said second hinge leaves are respectively adapted to be mounted to a door leaf or a door frame in either an upright or an upside down orientation; said socket part rigidly mounting means and said lower axle base rigidly mounting means each respectively including hinge arms respectively adapted to mount said first and second hinge leaves to said axle base and socket part with said center axle extending upwardly when said first and second hinge leaves are in said upright orientation or in said upside down orientation.

4. A door hinge as in claim 1 or claim 3 wherein said center axle has a vertical center bore adapted to slidably removably receive a latch bolt;

said hinge arms having bores adapted to slidably receive therein said latch bolt which hinge arm bores may be axially aligned to lock said upper hinge leaf against rotation.

5. A door hinge as in claim 3 wherein said orbital grooves each have a first horizontal portion at said vertical peak subtending a first given angle of rotation about said longitudinal axis, a second horizontal portion at said vertical bottom subtending a second given angle of rotation about said longitudinal axis inclined portions between said first and second horizontal portions so that when said door hinge is mounted to a door, said door closes automatically along said grooves to close the door when each of said ball bearings are in said inclined portion of said grooves and said door is released, said door remaining stationary when said ball bearings are each in said first horizontal portion.

* * * * *